US007214090B2

(12) United States Patent
Aihara et al.

(10) Patent No.: US 7,214,090 B2
(45) Date of Patent: May 8, 2007

(54) CONNECTOR DEVICE

(75) Inventors: Tetsuya Aihara, Yokkaichi (JP); Eiji Kojime, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 30 days.

(21) Appl. No.: 11/130,577

(22) Filed: May 16, 2005

(65) Prior Publication Data

US 2005/0260883 A1 Nov. 24, 2005

(30) Foreign Application Priority Data

May 19, 2004 (JP) ..... 2004-149123
Aug. 18, 2004 (JP) ..... 2004-238544

(51) Int. Cl.
*H01R 13/58* (2006.01)

(52) U.S. Cl. ..... 439/475; 439/358

(58) Field of Classification Search ..... 439/475, 439/474, 350–358, 680, 466, 473
See application file for complete search history.

(56) References Cited

U.S. PATENT DOCUMENTS 4,109,989 A * 8/1978 Snyder et al. ..... 439/140
4,986,766 A 1/1991 Leonard et al.
5,613,881 A 3/1997 Ichida et al.
5,762,520 A 6/1998 Martin
6,347,952 B1 * 2/2002 Hasegawa et al. ..... 439/352
6,350,159 B1 2/2002 Wu
6,494,733 B2 * 12/2002 Saka et al. ..... 439/352
6,503,108 B1 1/2003 Kikuchi et al.
6,565,388 B1 * 5/2003 Van Woensel et al. ..... 439/610
6,592,392 B2 * 7/2003 Po-Heng ..... 439/358
6,641,424 B1 * 11/2003 Hanak et al. ..... 439/352
6,663,397 B1 12/2003 Lin et al.
6,666,708 B2 * 12/2003 Saito ..... 439/466
6,676,433 B1 * 1/2004 Ozaki ..... 439/353
6,733,343 B2 * 5/2004 Morita et al. ..... 439/680
6,824,417 B1 * 11/2004 Nimura ..... 439/352
6,929,499 B2 * 8/2005 Nakamura ..... 439/352
2004/0033714 A1 2/2004 Maini et al.

FOREIGN PATENT DOCUMENTS

CH 683647 4/1994
JP 2001-283975 10/2001

* cited by examiner

*Primary Examiner*—Gary F. Paumen
(74) *Attorney, Agent, or Firm*—Gerald E. Hespos; Anthony J. Casella

(57) ABSTRACT

Male connectors (10) are accommodated in an ECU casing C, and connect with female connectors (20) connected with ends of wires (Wa). The male and female connectors (10, 20) are locked together by engaging a lock (45) on a lock arm (40) of the female connector (20) with an engaging portion (47) of the male connector (10). The fracture strength of the engaging portion (47) of the male connector (10) exceeds the fracture strength of the lock (45) of the female connector (20). Thus, an excessive force acting to separate the locked connectors (10, 20) will fracture the lock (45) of the female connector (20) first to cancel the locked state. This avoids fracturing the engaging portion (47) of the male connector (10).

15 Claims, 10 Drawing Sheets

CONNECTOR DEVICE

BACKGROUND OF THE INVENTION

1. Field of the Invention

The invention relates to a connector device in with male and female connectors that are connected separately.

2. Description of the Related Art

Japanese Unexamined Patent Publication No. 2001-283975 discloses a known electronic control unit (ECU) with connectors on side surfaces of an ECU casing. The connectors are mated with connectors at ends of a wiring harness. The ECU connector has a lock and the harness-side connector has a resilient lock arm that engages the lock for locking the connectors together.

A force may act to separate the locked connectors. Such a force might be generated, for example, if the wiring harness drawn out from the harness-side connector is pulled inadvertently. An excessive force of this type could fracture the lock or other parts of the locking mechanism. The device-side connector could be integral with the ECU casing. Thus, a lock failure could require replacement of the entire ECU casing and could require considerable labor and cost for repair.

The invention was developed in view of the above problem and an object thereof is to improve operational efficiency and to allow an easier exchange of connectors.

SUMMARY OF THE INVENTION

The invention relates to a connector device with a fixed connector and a movable connector. The fixed connector is mounted integrally or unitarily to another member. The other movable connector is connectable with and separable from the fixed connector. The two connectors are locked together by the engagement of locks provided therein. The fracture strength of the lock of the fixed connector exceeds the fracture strength of the movable connector.

A force could act to separate the locked connectors, and could be sufficiently great to cause a fracture, such as a shear fracture. The fracture strength refers to strength against such a fracture. The fracture strength can be calculated based on the material strength and the shear area of the lock. Specifically, the fracture strength can be calculated as a product of the material shear strength and the shear area. The fracture strength also can be calculated by multiplying this product by a coefficient based on the shape characteristic of the lock:

$$\text{fracture strength [N]} = \text{material shear strength [N/mm}^2\text{]} \times \text{shear area [mm}^2\text{]} \times \text{coefficient}$$

An excessive force that acts in a direction to separate the two locked connectors will fracture the lock of the movable connector first and will cancel the locked state. However, the lock of the fixed connector will not fracture. The movable connector can be exchanged relatively easily. Thus, repairs can be made easily and inexpensively.

The movable connector preferably includes a resiliently deformable lock arm that is formed with a lock. The fixed connector preferably includes an engaging portion that is engageable with the lock of the lock arm. The fracture strength of the engaging portion of the fixed connector is larger than the fracture strength of the lock of the movable connector.

The connectors are locked together by engaging the lock of the lock arm with the engaging portion. An excessive force to separate the locked connectors will fracture the lock of the lock arm of the movable connector to cancel the locked state, but the engaging portion will not fracture.

The lock arm preferably has a three-point supporting construction.

At least one rib is formed at a side of the engaging portion of the fixed connector and extends substantially in a connecting direction. The rib is fittable into a guiding groove in the movable connector and is adapted to prevent a forcible connection. A side surface of the engaging portion preferably is coupled to the rib. Thus, the fracture strength of the engaging portion is increased without taking up extra space. The projecting distance of the rib preferably exceeds the projecting distance of the engaging portion.

The fracture strength of the lock of the fixed connector preferably is at least about 1.3 times larger, more preferably at least about 1.5 times larger, most preferably at least about 1.7 times larger than the fracture strength of the lock of the movable connector.

Ribs and grooves preferably are provided on the connectors to avoid an improper connection.

A cover preferably is mounted to the movable connector to at least partly cover a wire draw out portion thereof.

These and other features of the invention will become more apparent upon reading the following detailed description and accompanying drawings. It should be understood that even though embodiments are described separately, single features may be combined to additional embodiments.

DETAILED DESCRIPTION OF THE PREFERRED EMBODIMENTS

A connector device according to a first embodiment of the invention is illustrated in FIGS. 1 to 7. The connector device includes male and female connectors 10 and 20 that are connectable with one another. In the following, mating sides of connectors 10, 20 are referred to as the front.

Figure 1:
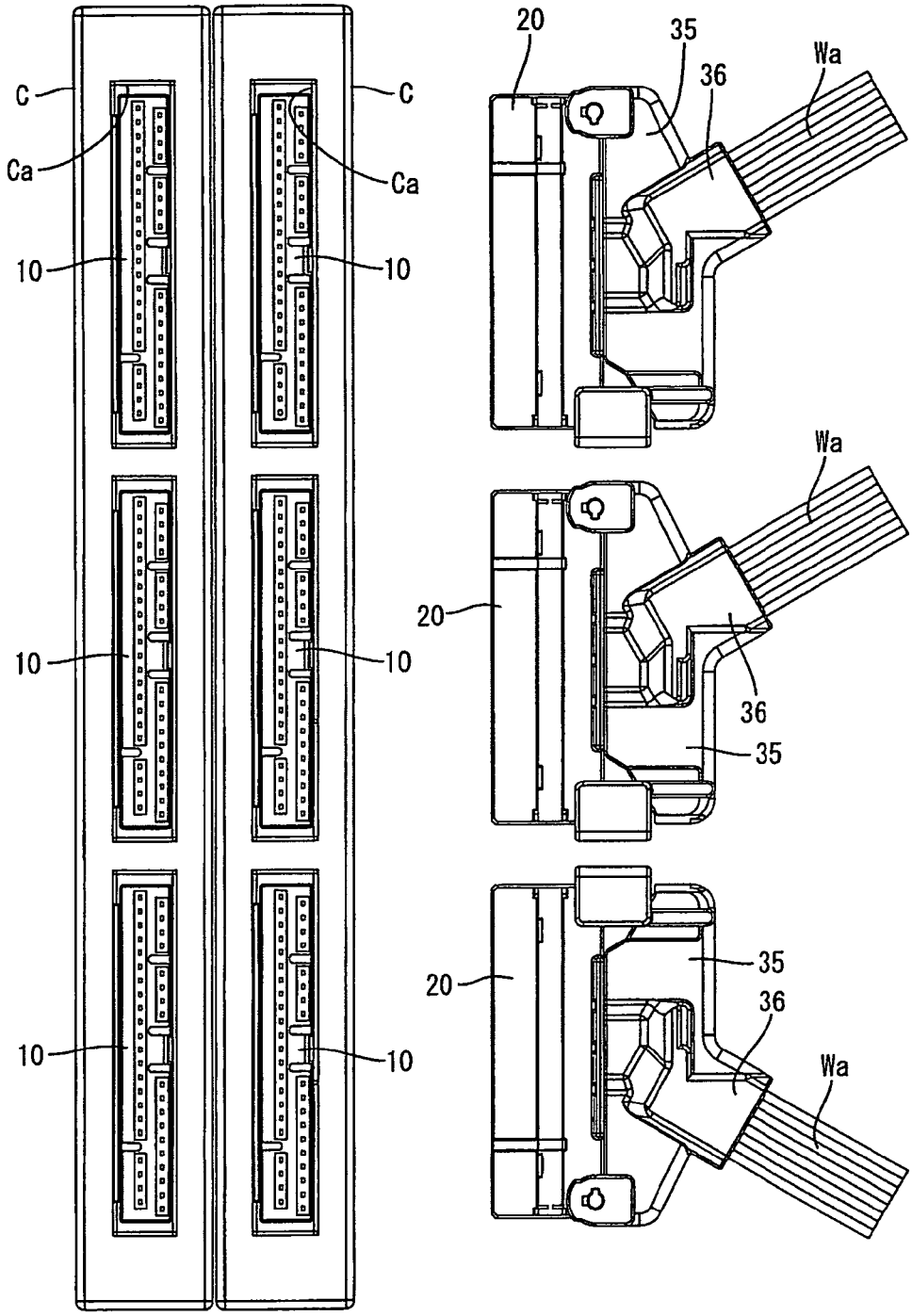
FIG. 1 is a front view of an ECU casing and a side view of female connectors according to a first embodiment of the invention.
Figure 2:
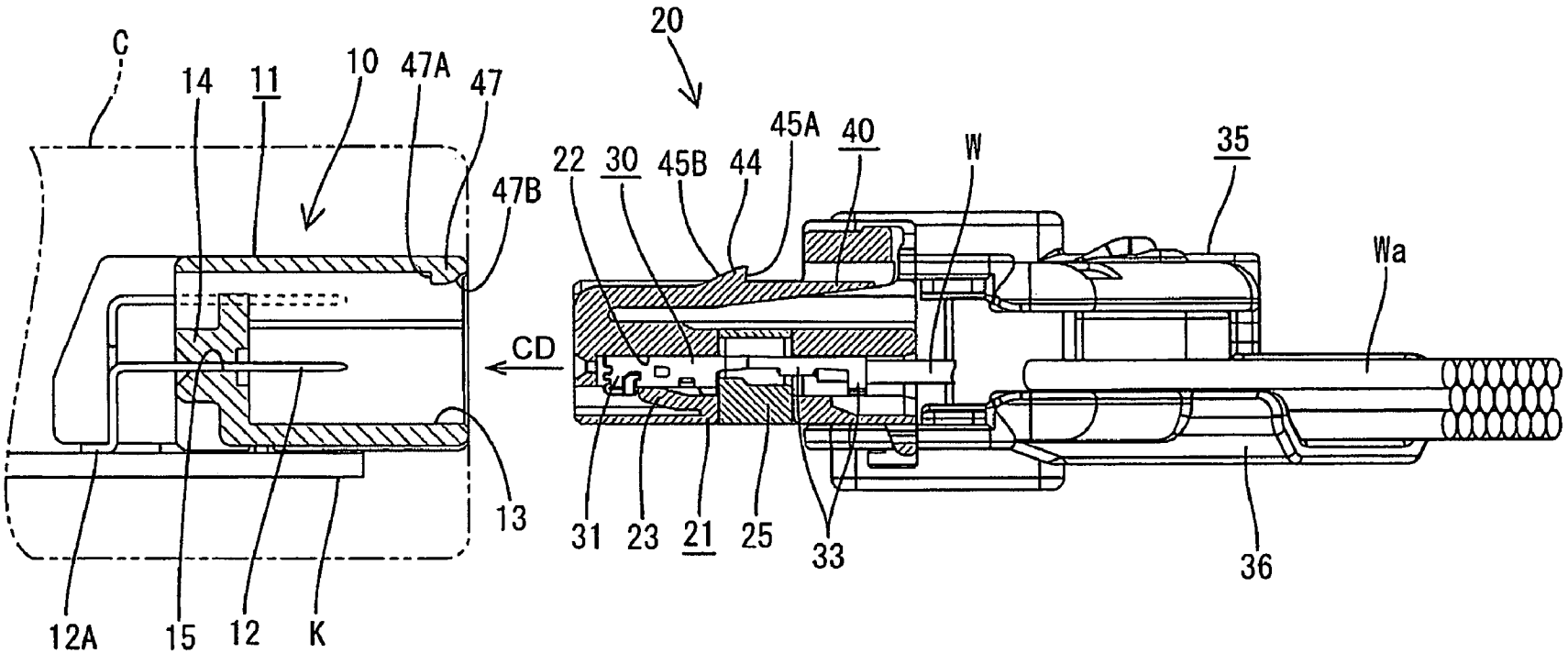
FIG. 2 is a section showing a state before the female connector is connected with a male connector.

As shown in FIGS. 1 and 2, three male connectors 10 are aligned on one surface of an ECU (electronic control unit) casing C that is a vertically long flat box. Several such ECU casings preferably are arranged side-by-side. Female connectors 20 are connectable with the respective male connectors 10 along a connecting direction CD.

Figure 3:
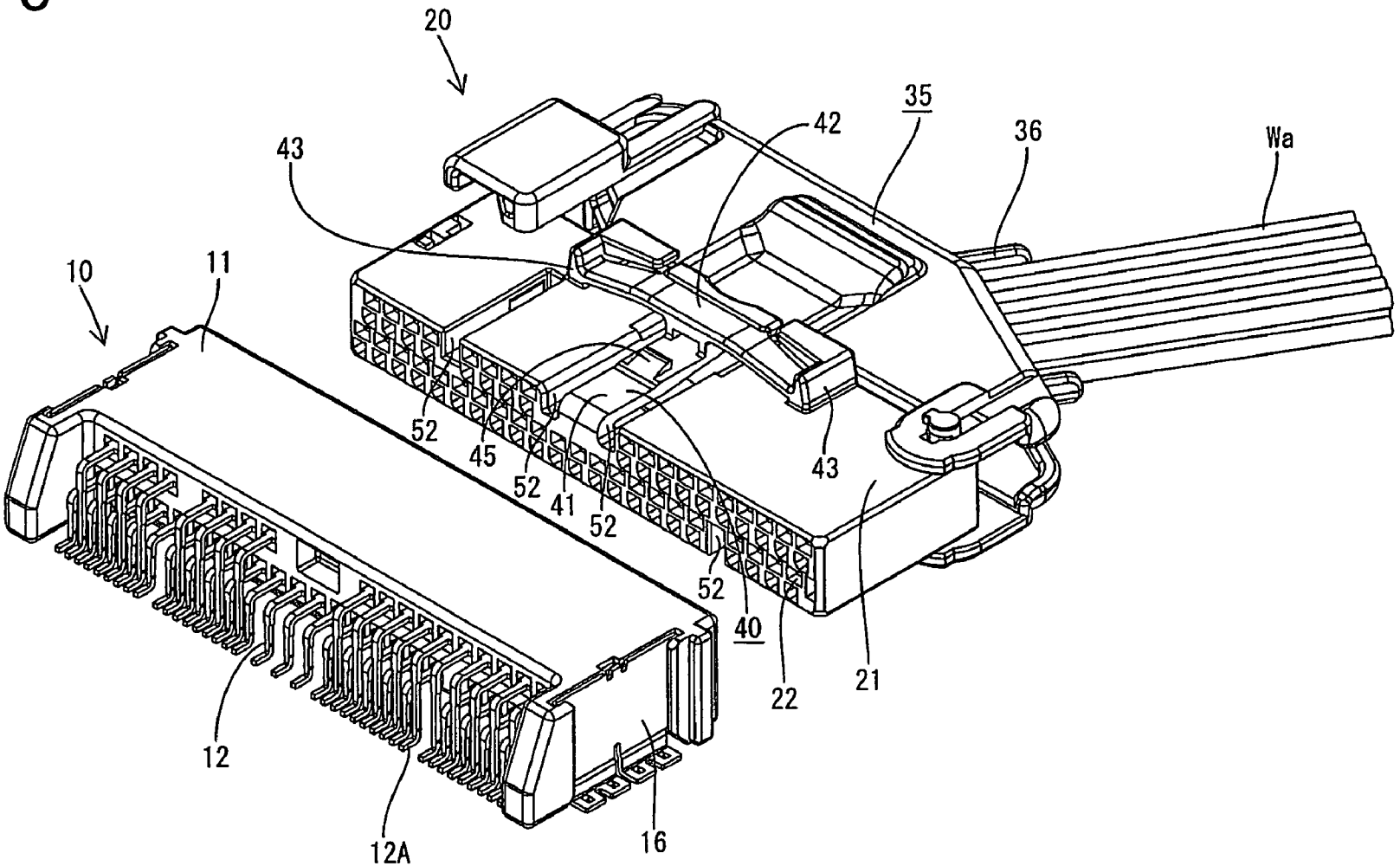
FIG. 3 is a perspective view showing the state before the female connector is connected with the male connector.
Figure 4:
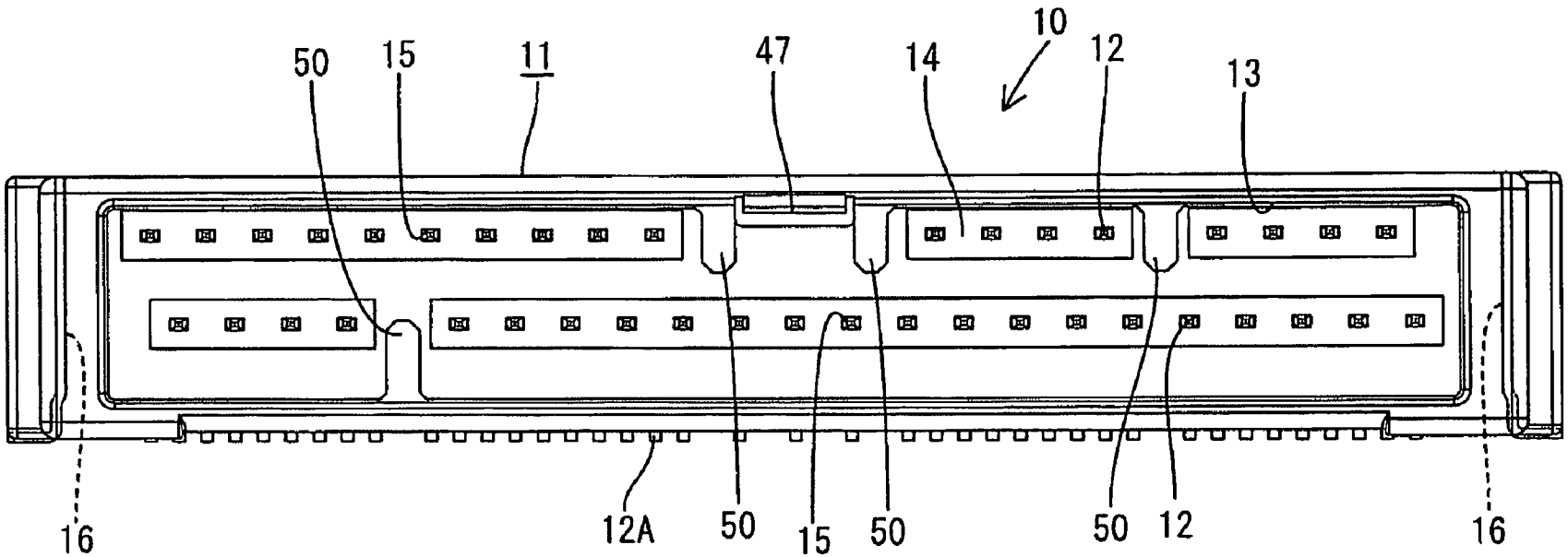
FIG. 4 is a front view of the male connector.

The male connector 10 is a circuit board connector to be mounted on a printed circuit board K. The male connector 10 has a male housing 11 that is made of a synthetic resin, and male terminal fittings 12 are mounted in the male housing 11. As also shown in FIGS. 3 and 4, the male housing 11 is wide and has a fitting recess 13 in its front mating surface. Terminal insertion holes 15 are formed at upper and lower stages in a base wall 14 at the back of the fitting recess 13. The terminal insertion holes 15 at the upper stage are offset from those at the lower stage.

Tab-shaped ends of the male terminal fittings 12 are inserted through the corresponding terminal insertion holes 15 and project into the fitting recess 13 in alignment. The opposite ends of the male terminal fittings 12 project back from the base wall 14 and are bent down at substantially right angles at specified positions. The rear ends of the male terminal fittings 12 then are bent back at substantially right angles to define connecting portions 12A.

The male connector 10 is to be placed at a specified position on the board K with the fitting recess 13 faced outward. Fixing members 16 are mounted on opposite side surfaces of the housing 11 and are fixed to the circuit board K by soldering, (ultrasonic) welding, press-fitting, insulation displacement mounting or the like. The connecting portions 12A of the male terminal fittings 12 are soldered, welded, press-fitted or otherwise connected to corresponding conductor paths on the board K.

The board K having the male connectors 10 mounted thereon is accommodated into the ECU casing C. Accordingly, the respective male connectors 10 are fit in window holes Ca in a surface of the casing C.

Figure 5:
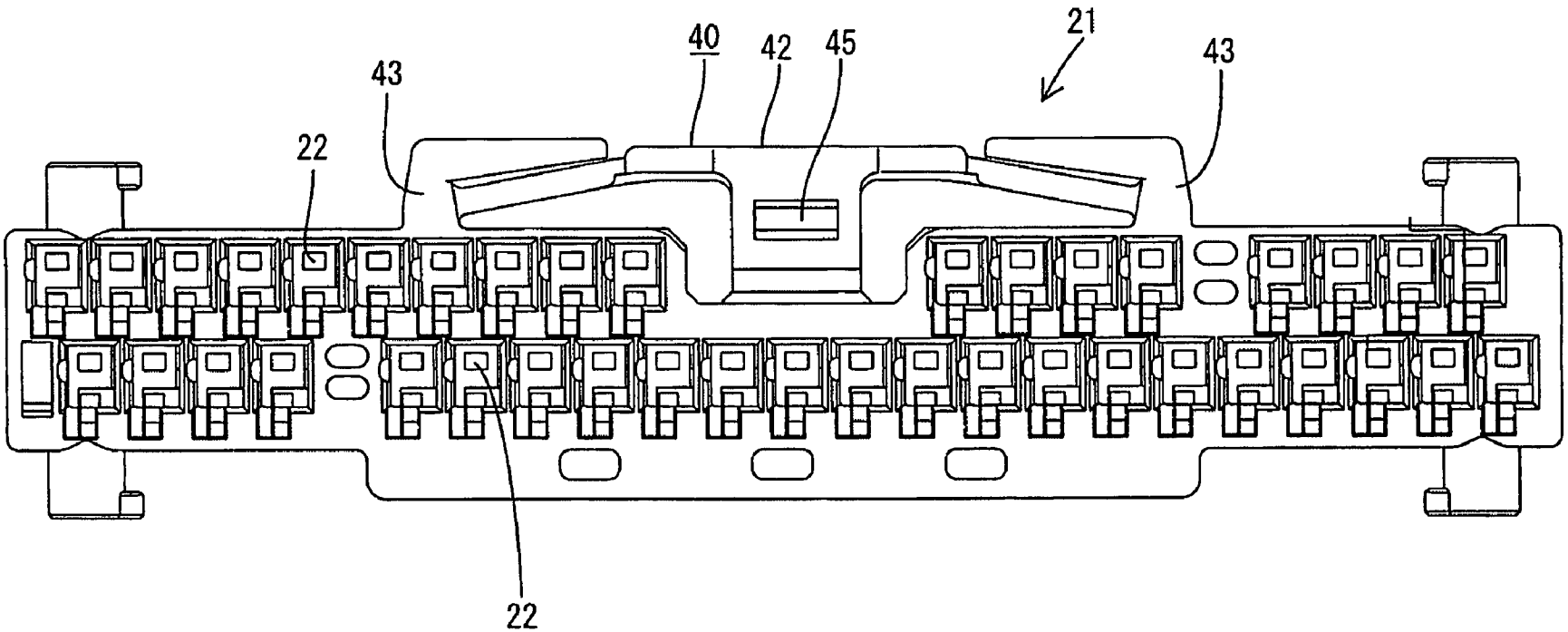
FIG. 5 is a rear view of the female housing.

The female connector 20 includes a female housing 21 made e.g. of a synthetic resin. The female housing 21 is a wide block that is fittable into the fitting recess 13 of the male housing 11, as shown in FIGS. 3 and 5. Cavities 22 are formed at upper and lower stages in the female housing 21 for accommodating female terminal fittings 30. The cavities 22 are arranged to align with the male terminal fittings 12 of the male connector 10. Thus, the cavities 22 at the upper stage are offset from those at the lower stage.

Each female terminal fitting 30 has a rectangular tubular main portion 31 with a resilient contact piece 32 (see FIG. 6) for contacting the mating male terminal fitting 12. A barrel is provided behind the main portion 31 for crimped connection to an end of a wire W.

The female terminal fitting 30 is inserted into the cavity 22 from behind, and is locked at a proper position by a locking portion 23 at the bottom wall of the cavity 22. The female terminal fitting 30 then is locked redundantly in the cavity 22 by a retainer 25 and the wire W is drawn out backward through the rear entrance of the cavity 22.

A cover 35 made e.g. of a synthetic resin is mounted on the rear surface of the female housing 21. The cover 35 accommodates the wires W drawn out through the rear surface of the female housing 21 together as a wire group Wa and introduces the wires W in a specified direction through a wire lead-out opening 36. The lead-out opening may have a tubular shape or at least one lateral guide projection.

A lock arm 40 is provided in substantially the widthwise middle of the upper surface of the female housing 21. The lock arm 40 has an arm main body 41 that projects up from the front edge of the upper surface of the female housing 21 and then extends back. An unlocking portion 42 extends substantially in a width direction at the rear end of the arm main body 41. Opposite ends of the unlocking portion 42 are coupled to protection walls 43 that project from the upper surface of the female housing 21. Thus, the lock arm 40 has a three-point supporting construction and is resiliently displaceable substantially along a vertical direction that is substantially normal to the connecting direction CD. A lock 45 is formed on the arm main body 41 of the lock arm 40. A substantially upright locking surface 45A is formed at the rear of the lock 45 with respect to a connecting direction CD of the two connectors 10, 20 and is substantially normal to the connecting direction CD. A slanted guiding surface 45B is formed at the front of the lock 45.

An engaging portion 47 is formed near the front edge in a widthwise middle of the ceiling surface of the fitting recess 13 of the male housing 11 and is engageable with the lock 45 of the lock arm 40. A substantially upright locking surface 47A is formed on the rear of the engaging portion 47 with respect to the connecting direction CD of the two connectors 10, 20 and is substantially normal to the connecting direction CD. A slanted guiding surface 47B is formed on the front of the engaging portion 47.

Figure 6:
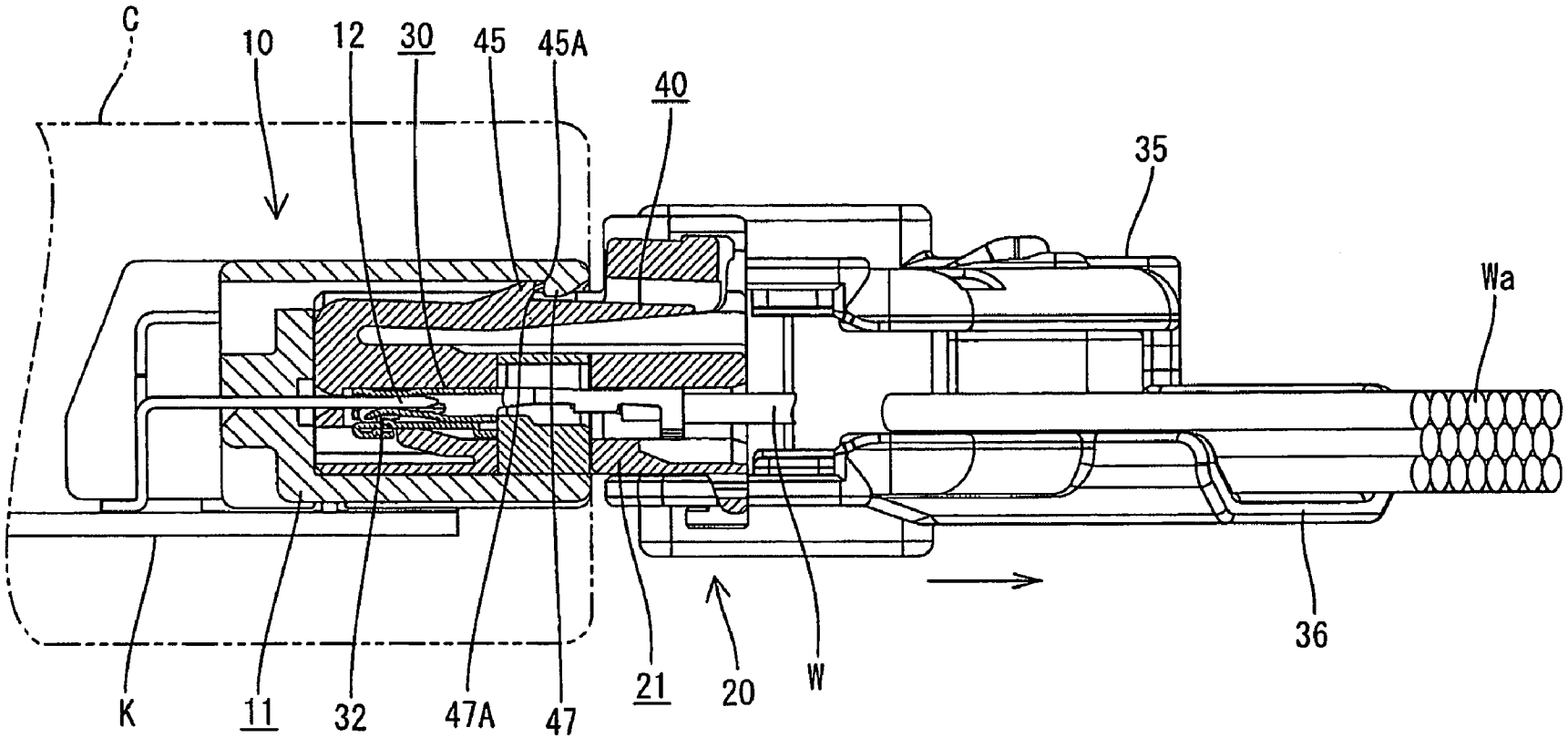
FIG. 6 is a section showing a state where the female connector is connected with the male connector.
Figure 7:
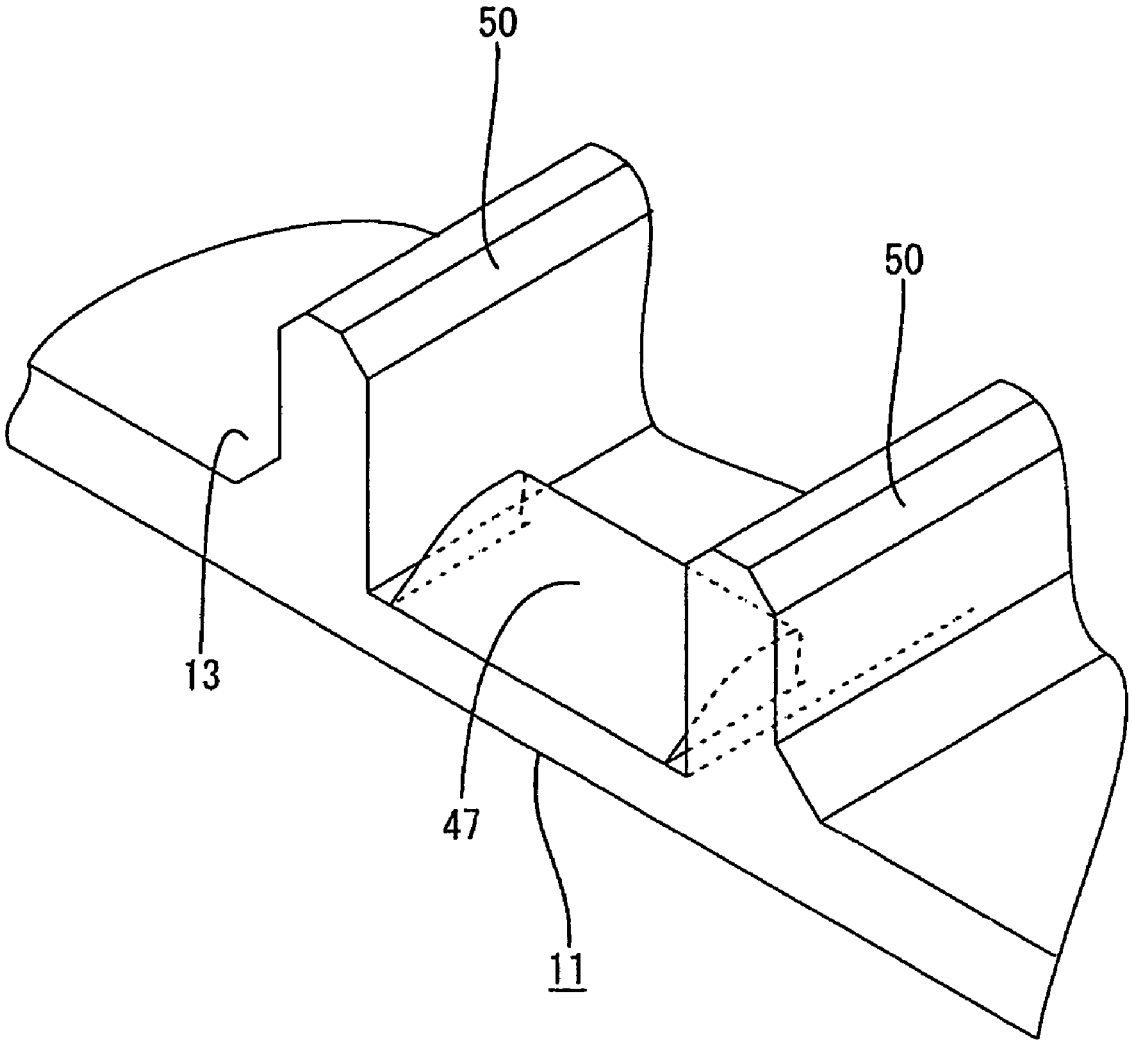
FIG. 7 is a perspective view showing a part where an engaging portion is formed.

As shown in FIG. 6, the locking surface 45A of the lock 45 of the lock arm 40 faces the locking surface 47A of the engaging portion 47 when the female connector 20 is fit properly into the male connector 10. Thus, the male and female connectors 10, 20 are locked together.

An excessive force may act to separate the connectors 10, 20 from the locked state shown in FIG. 6. This force acts after the locking surfaces 45A, 47A of the lock 45 and the engaging portion 47 are in contact. Thus, the lock 45 and the engaging portion 47 receive a shear force and could experience a fracture, such as a shear fracture. The lock 45 and the engaging portion 47 must be sufficiently strong to resist the fracture.

Accordingly, the fracture strength of the engaging portion 47 of the male connector 10 is made larger than the fracture strength of the lock 45 of the lock arm 40 of the female connector 20.

The fracture strengths of the lock 45 and the engaging portion 47 can be calculated based on the shear strengths of the materials and the shear areas thereof. Specifically, fracture strengths can be calculated as products of the material shear strengths and the shear areas or by multiplying these products by coefficients based on the shape characteristics of the lock 45 and the engaging portion 47:

$$\text{fracture strength [N]} = \text{material shear strength [N/mm}^2\text{]} \times \text{shear area [mm}^2\text{]} \times \text{coefficient}$$

For example, the fracture strength of the lock 45 of the female connector 20 could take a value of up to 155 N. The fracture strength of the engaging portion 47 of the male connector 10 then could be 200 N or larger (or more than about 1.3 times larger, more preferably more than about 1.5 times larger, most preferably more than about 1.7 times larger).

The male housing 11 has ribs 50 that extend forward and back along the connecting direction CD to prevent forcible connection of the connectors 10, 20 in an improper orientation. Three ribs 50 are on the ceiling surface of the fitting recess 13, and one rib 50 is on the bottom surface of the fitting recess 13. Two of the ribs 50 on the ceiling surface are spaced slightly from the opposite sides of the engaging portion 47. The ribs extend from the front edge of the fitting recess 13 to the back surface. The ribs 50 at lateral sides of the engaging portion 47 (as shown e.g. in FIG. 7) guide an engagement thereof and/or protect the engaging portion 47 against damage.

The female housing 21 has four guiding grooves 52 that extend forward and back along the connecting direction CD, as shown in FIG. 3. Two guiding grooves 52 are on the upper surface of the female housing 21 at opposite sides of the lock arm 40 and a third guiding groove 52 is further to the left on the ceiling surface when viewed from the front. A fourth guiding groove 52 is to the right on the bottom surface of the female housing 21. The ribs 50 fit closely in the guiding grooves 52.

Female terminal fittings 30 are inserted in the cavities 22 of the female housing 21 to start the assembly process. The retainer 25 then is pushed to a position for redundantly locking the female terminal fittings 30. Wires W drawn out through the rear surface of the female housing 21 are bundled as shown in FIG. 2. The cover 35 then is mounted on the rear of the female housing 21, and the bundled wire group Wa is drawn out through the wire lead-out opening 36.

The female connectors 20 having the covers 35 mounted thereon are connected along the connecting direction CD with the mating male connectors 10 in the windows Ca of the ECU casings C, as shown by the arrow of FIG. 2. As a result, the guiding surface 47B of the engaging portion 47 contacts the guiding surface 45B of the lock 45 and deforms the lock arm 40. The lock arm 40 is restored resiliently after sufficient pushing so that the locking surface 45A of the lock 45 engages the locking surface 47A of the engaging portion 47, as shown in FIG. 6. Thus, the male and female connectors 10, 20 are locked together and the corresponding male and female terminal fittings 12, 30 are connected properly.

The wire group Wa may be pulled, as shown by the arrow of FIG. 6, to generate a force that acts to separate the connectors 10, 20 while the connectors 10, 20 are locked together. Contact of the locking surfaces 45A, 47A of the lock 45 and the engaging portion 47 will hold the connectors 10, 20 together if the separation forces are low. However, the lock 45 and the engaging portion 47 may fracture if the force is excessive.

Accordingly, the engaging portion 47 of the male connector 10 is formed to have a fracture strength that exceeds the fracture strength of the lock 45 of the lock arm 40. Thus, the lock 45 of the lock arm 40 experiences a fracture first. The locked state is canceled when the lock fails and the female connector 20 can be pulled from the male connector 10. Thus, the engaging portion 47 of the mating male connector 10 will not fracture. The female housing 21 can be exchanged for a housing with a functioning locking mechanism.

As described above, an excessive force will fracture the lock 45 of the female connector 20 first to cancel the locked state. Thus, the engaging portion 47 of the male connector 10 in the ECU casing will not fracture.

A fracture of the engaging portion 47 of the male connector 10 would require a disconnection of the soldered connection to the circuit board K, an exchange the male housing 11, and either a reattachment of the new male housing 11 to the board K or the preparation of a new board K. The entire ECU casing also might need replacement. Such exchanges take labor and cost. However, only the female housing 21 needs to be replaced if the lock 45 of the lock arm 40 of the female connector 20 is fractured. The locking mechanism can be repaired easily and inexpensively repaired merely by a simple operation of reinserting the female terminal fittings 30.

Figure 8:
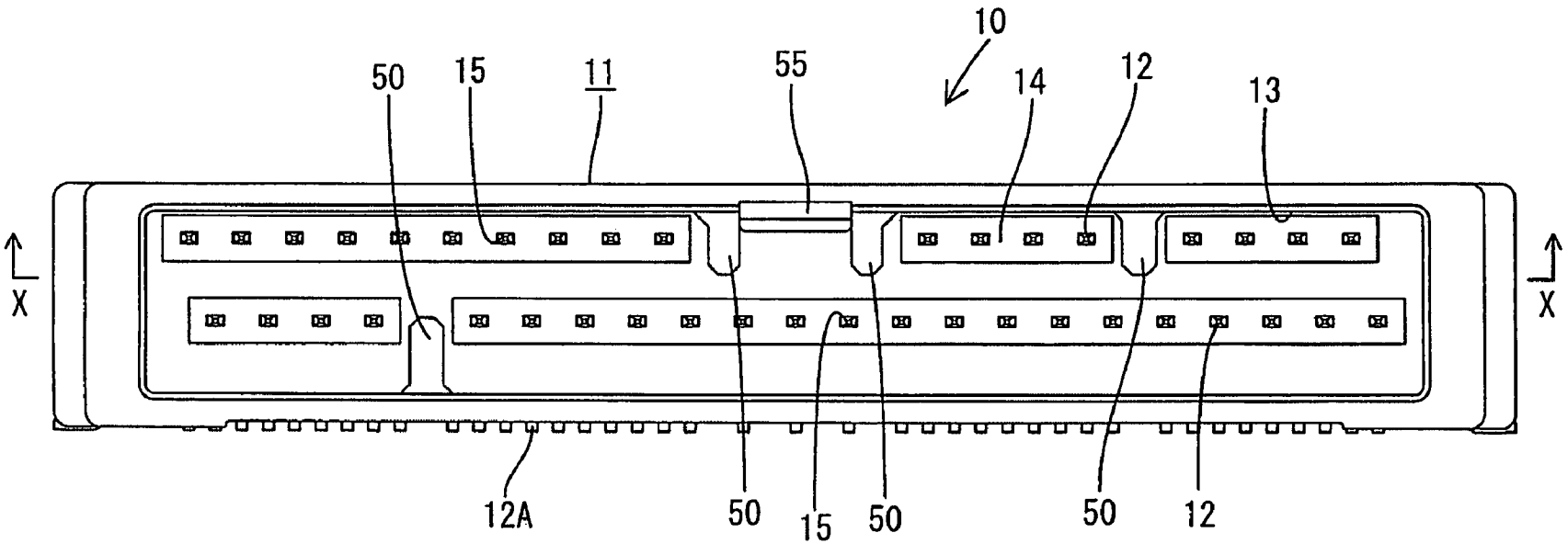
FIG. 8 is a front view of a male connector according to a second embodiment.
Figure 9:
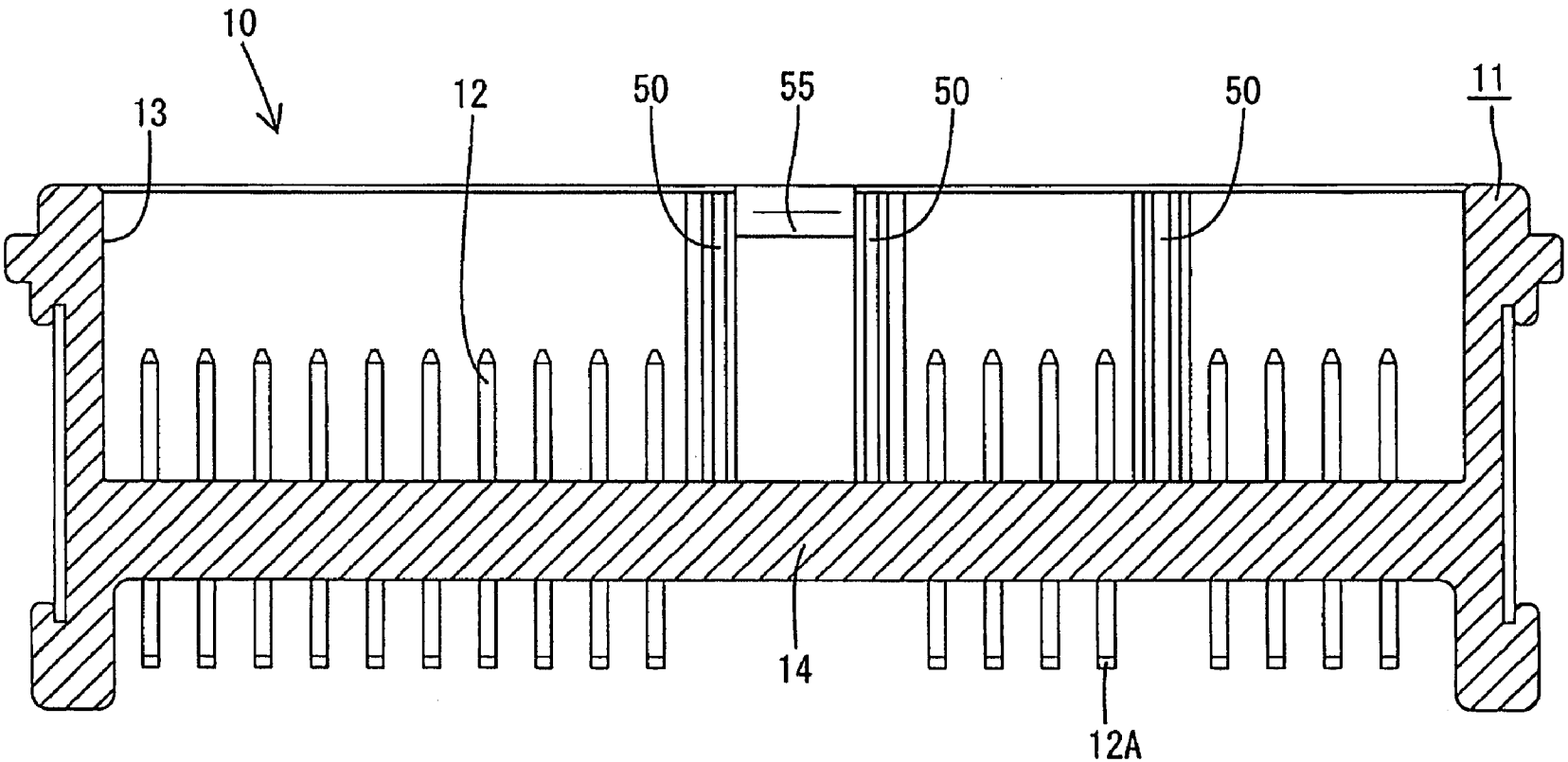
FIG. 9 is a section along 9—9 of FIG. 8.
Figure 10:
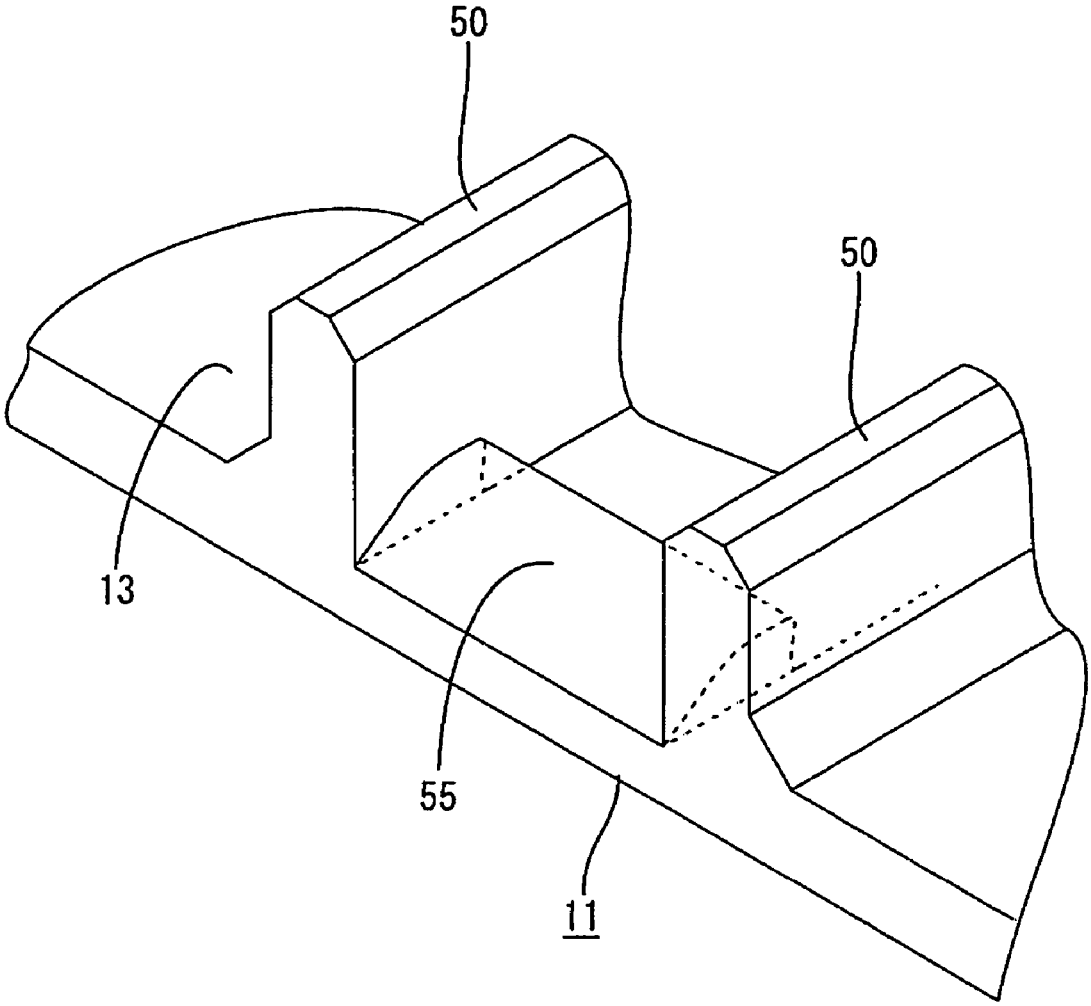
FIG. 10 is a perspective view showing a part where an engaging portion is formed.

FIGS. 8 to 10 show a second embodiment of the invention. The engaging portion 47 of the first embodiment is spaced from the ribs 50. However, the engaging portion 55 of the second embodiment is coupled unitarily to the ribs 50 at the opposite left and right ends. The other construction is the same as or similar to the first embodiment. These similar parts are identified by the same reference numerals, but are not described again.

The engaging portion 55 of the second embodiment is wider than the engaging portion 47 of the first embodiment to increase the shear area. Additionally, the engaging portion 55 is coupled unitarily with the ribs 50 to provide a high rigidity and increased fracture strength. Accordingly, an excessive force that acts in a direction to separate the two locked connectors 10, 20 will cause the lock 45 of the lock arm 40 to fracture first, thereby canceling the locked state. Thus, the engaging portion 55 of the male connector 10 is even less likely to fracture.

The widening of the engaging portion 55 eliminates only the clearances for the ribs 50, i.e. dead spaces. Thus, extra space is not needed for this increase in the fracture strength of the engaging portion 55, and the male housing 11 is not enlarged. The projecting height of the ribs 50 preferably exceeds the projecting height of the engaging portion 55.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Numerical values of the fracture strength shown in the foregoing embodiment are merely examples and can be suitably selected according to using conditions and the like.

The fixed connector can have a housing that is integral or unitary with a casing of the device.

The invention is applicable to a case where the fixed connector is a female connector and the movable connector is a male connector.

The cover on the female connector can be omitted.

The invention is applicable to all kinds of connectors, in particular those mounted to other electric or electronic devices, such as junction boxes, dashboard panels, etc.

What is claimed is:

1. A connector device, comprising: a fixed connector having a housing mounted securely on another member, a receptacle being formed in the housing, an engaging portion being formed on the housing and projecting into the receptacle, and a movable connector connectable with and separable from the fixed connector, the two connectors being locked together by engaging a lock of the movable connector with the engaging portion of the fixed connector, the lock and the engaging portion each having a fracture strength proportional to a product of a material shear strength for the material from which the lock and the engaging portion are formed and a shear area of the respective lock and the engaging portion, the engaging portion being dimensioned and configured so that the fracture strength of the engaging portion of the fixed connector exceeds the fracture strength of the lock of the movable connector.

2. The connector device of claim 1, wherein the movable connector includes a resiliently deformable lock arm , the lock of the movable connector being on the lock arm .

3. The connector of claim 2, wherein the lock arm has a three-point supporting construction.

4. The connector device of claim 1, wherein at least one rib is formed at least at one side of the engaging portion of the fixed connector and extends substantially in a connecting direction , the movable connector having at least one guiding groove for receiving the rib when the connectors are oriented properly.

5. The connector device of claim 4, wherein a side surface of the engaging portion is coupled to the rib .

6. The connector device of claim 5, wherein a projecting distance of the rib exceeds a projecting distance of the engaging portion .

7. The connector device of claim 4, wherein a plurality of ribs and grooves are provided on each of the connectors to avoid an improper connection thereof.

8. The connector device of claim 1, wherein the fracture strength of the engaging portion of the fixed connector is more than about 1.3 times larger than the fracture strength of the lock of the movable connector.

9. The connector device of claim 1, wherein the fracture strength of the engaging portion of the fixed connector is more than about 1.5 times larger than the fracture strength of the lock of the movable connector.

10. The connector device of claim 1, wherein the fracture strength of the engaging portion of the fixed connector is more than about 1.7 times larger than the fracture strength of the lock of the movable connector.

11. The connector device of claim 1, wherein a cover is mounted to the movable connector to at least partly cover a wire draw out portion thereof.

12. A connector device, comprising:

a movable connector having a resiliently deformable lock arm with a lock formed thereon, grooves formed on opposite sides of the lock arm ; and a fixed connector connectable with and separable from the movable connector , at least two spaced apart ribs disposed for slidably entering the grooves when the connectors are connected, an engaging portion formed on the fixed connector and disposed for engaging the lock on the lock arm when the two connectors are connected, the engaging portion having opposite ends coupled unitarily to the ribs so that the engaging portion has a fracture strength greater than a fracture strength of at least one of the lock and the lock arm .

13. The connector device of claim 12, wherein a projecting distance of the ribs exceeds a projecting distance of the engaging portion .

14. The connector of claim 12, wherein the lock arm has a three-point supporting construction.

15. The connector device of claim 12, wherein the fracture strength of the engaging portion of the fixed connector is more than about 1.3 times larger than the fracture strength of the lock of the movable connector.

* * * * *

UNITED STATES PATENT AND TRADEMARK OFFICE

CERTIFICATE OF CORRECTION

PATENT NO. : 7,214,090 B2
APPLICATION NO. : 11/130577
DATED : May 8, 2007
INVENTOR(S) : Tetsuya Aihara et al.

It is certified that error appears in the above-identified patent and that said Letters Patent is hereby corrected as shown below:

Title Page; should read;
(75) Inventors: Tetsuya Aihara, Yokkaichi (JP); Eiji Kojima, Yokkaichi (JP)

Signed and Sealed this

Seventeenth Day of July, 2007

JON W. DUDAS
*Director of the United States Patent and Trademark Office*